United States Patent [19]

Wey

[11] Patent Number: 5,016,830

[45] Date of Patent: May 21, 1991

[54] METHOD AND DEVICE FOR COMBINING PAIRS OF CHEESES

[75] Inventor: Edmund Wey, Netteltal, Fed. Rep. of Germany

[73] Assignee: W. Schlafhorst AG & Co., Monchen-Gladbach, Fed. Rep. of Germany

[21] Appl. No.: 291,249

[22] Filed: Dec. 27, 1988

[30] Foreign Application Priority Data

Dec. 24, 1987 [DE] Fed. Rep. of Germany ..... 3744041

[51] Int. Cl.[5] ..... B65H 67/04

[52] U.S. Cl. ..... 242/35.50 A; 242/35.50 R

[58] Field of Search ..... 242/35.5 A, 35.5 R; 198/447

[56] References Cited

U.S. PATENT DOCUMENTS

| | | | |
|---|---|---|---|
| 4,175,711 | 11/1979 | Kamp | 242/35.5 A |
| 4,555,215 | 11/1985 | Raasch et al. | 242/35.5 A |
| 4,657,194 | 4/1987 | Wey et al. | 242/35.5 A |
| 4,690,342 | 9/1987 | Langen | 242/35.5 A |
| 4,721,262 | 1/1988 | Langen | 242/35.5 A |

FOREIGN PATENT DOCUMENTS

| | | | |
|---|---|---|---|
| 0026160 | 4/1981 | European Pat. Off. | 242/35.5 A |
| 3418814 | 11/1985 | Fed. Rep. of Germany . | |
| 3604018 | 9/1987 | Fed. Rep. of Germany | 242/35.5 R |

*Primary Examiner*—Daniel P. Stodola
*Assistant Examiner*—Paul Thomas Bowen
*Attorney, Agent, or Firm*—Herbert L. Lerner; Laurence A. Greenberg

[57] ABSTRACT

A method and device for combining cheese pairs made up of cheeses of different types in a cheese-producing textile machine having a plurality of adjacent winding stations and a cheese transporter disposed along the machine, the cheese transporter having an end at which the cheeses become disposed for further availability, the cheese transporter including at least one mobile automatic cheese exchanger for removing the cheeses from the winding stations and readying them for further transport, which comprises automatically transforming the cheeses to the cheese transporter in cooperation with the mobile automatic cheese exchanger; after depositing a row of pairwise arranged cheeses on the cheese transporter, setting the cheese transporter into motion only when at least one of the following has been determined by automatic devices: that the winding stations have delivered the cheeses correctly and in the correct amounts, that the predetermined amount of cheese pairs is present, that irregular pairs of cheeses and excess cheeses are identified as such and that the original winding station of irregular cheeses has been identified, and a device for performing.

19 Claims, 7 Drawing Sheets

METHOD AND DEVICE FOR COMBINING PAIRS OF CHEESES

The invention relates to a method and a device for combining cheese pairs made up of cheeses of different types, in particular cheeses having different yarn lengths, in a cheese-producing textile machine, having a plurality of adjacent winding stations and having a cheese transporter disposed along the machine, the cheese transporter having an end at which the cheeses become disposed for further availability, the cheese transporter including at least one mobile automatic cheese exchanger for removing the cheeses from the winding stations and reading them for further transport.

Cheese pairs are used, for example, as supply coils in yarn combining devices. Twisters, doubling winders and winders cooperating with coil supply creels are considered to be yarn combining devices.

It is possible that the individual coils of cheese pairs do not outwardly differ in appearance. If one yarn winds around another, for example, in the yarn combining device, it is a matter of chance as to which of the two supply coils supplies the core thread and which the cover thread. For this reason, it is impossible from the very start to consider the different yarn lengths during cheese preparation so that as little as possible wasted yarn results when the yarns are combined. If piecing is to be avoided in the course of the combining process, the cheeses of the one type must have a considerably greater yarn length than would be required for a yarn of a predetermined length made from individual threads. In most cases the remaining lengths are no longer usable for a quality product.

It is accordingly an object of the invention to set the conditions for the most error-free and rapid possible formation of cheese pairs of different types.

With the foregoing and other obJects in view, there is provided, in accordance with the invention, a method of combining cheese pairs made up of cheeses of different types in a cheese-producing textile machine having a plurality of adjacent winding stations and a cheese transporter disposed along the machine, the cheese transporter having an end at which the cheeses become disposed for further availability, the cheese transporter including at least one mobile automatic cheese exchanger for removing the cheeses from the winding stations and readying them for further transport, which comprises automatically transferring the cheeses to the cheese transporter in cooperation with the mobile automatic cheese exchanger: after depositing a row of pairwise arranged cheeses on the cheese transporter, setting the cheese transporter into motion only when at least one of the following has been determined by automatic devices: that the winding stations have delivered the cheeses correctly and in the correct amounts, that the predetermined amount of cheese pairs is present, that irregular pairs of cheeses and excess cheeses are identified as such and that the original winding station of irregular cheeses has been identified.

In accordance with another mode of the invention, there is provided a method which includes automatically depositing the cheeses of a first type in a row at spaced distances from one another equal to more than the length of a single cheese, respectively; and subsequently depositing the cheeses of a second type, respectively, into the spaces between the cheeses of the first type.

In accordance with a further mode of the invention, there is provided a method which includes initially lining up the cheeses automatically on a storage device disposed along the machine producing the cheeses, and automatically transferring the cheeses together from the storage device to the cheese transporter.

In accordance with an added mode of the invention, there is provided a method which includes initially lining up the cheeses of one type automatically at spaced distances from one another on the storage device and, from there, automatically transferring them all together to the cheese transporter; and then lining up the cheeses of another type automatically at spaced distances from one another on the same storage device, and then automatically transferring them to the cheese transporter.

In accordance with an additional mode of the invention, there is provided a method which comprises always depositing the cheeses of one type automatically at a spaced distance from one another on the storage device only; and always depositing the cheeses of another type automatically at a spaced distance from one another on the cheese transporter only; and, after both the storage device as well as the cheese transporter have had a prescribed amount of cheeses deposited thereon, depositing the cheeses located on the storage device automatically in the spaces between the cheeses located on the cheese transporter.

In accordance with again another mode of the invention, there is provided a method which includes moving the cheese transporter forward a distance corresponding to one-half the middle spacing of the cheeses of the other type on the cheese transporter.

In accordance with yet a further mode of the invention, there is provided a method which includes depositing the cheeses of the one type on the cheese transporter at the middle spacing of the winding stations, and then moving the cheese transporter forward by half of the middle spacing of the winding stations in order to receive the cheeses of the other type in this position.

In accordance with yet an added mode of the invention, there is provided a method which includes successively removing with the mobile cheese exchanger cheeses of one type initially, and then cheeses of another type from the winding stations, and depositing the cheeses in order.

In accordance with yet an additional mode of the invention, there is provided a method which comprises producing cheeses of one type at given winding stations of the cheese-producing machine, and simultaneously at other winding stations of the machine, producing cheeses of another type and by means of the mobile cheese exchanger, removing the cheeses of both types from the winding stations in any sequence and depositing the cheeses in order.

In accordance with another aspect of the invention, there is provided a device for combining cheese pairs made up of cheeses of different types in a cheese-producing textile machine having a plurality of adjacent winding stations and a cheese transporter disposed along the machine, the cheese transporter having an end at which the cheeses are disposed for further availability including at least one mobile automatic cheese exchanger for removing the cheeses from the winding stations and readying them for further transport, comprising a control device in the cheese-producing machine cooperating with the winding station of the machine, the cheese exchanger, and the cheese transporter, the control device having a control program for controlling the cheese exchanger so that cheeses of two different types reach the cheese transporter in a paired arrangement, and so that the cheese transporter is releasable for transporting the cheeses only if at least one of the following applies: the cheese transporter contains cheeses of both types arranged pairwise in a predetermined minimum amount without excess single bobbins: the winding stations have delivered the cheeses correctly and in correct amounts, irregular pairs of cheeses or excess cheeses have been identified as such, and the original winding station or irregular cheeses have been identified.

In accordance with another feature of the invention, the control device is cooperatively connected to sensors for performing a monitoring function including at least one of monitoring the winding stations for correct functioning, monitoring the winding station for correct delivery of correct cheeses, monitoring the cheese transporter for excessive single bobbins, and monitoring the cheese transporter for correct cheese pairs in correct amounts.

In accordance with a further feature of the invention, there is provided at least one identification device cooperatively connected with the control device for identifying at least one of the following: excess individual bobbins, incorrect pairs of bobbins, and incorrectly functioning winding stations.

In accordance with an added feature of the invention, the cheese-producing textile machine has a storage device for collecting one type of cheese prior to transferring the cheeses to the cheese transporter, the control device and the mobile automatic cheese exchanger being programmed for interim storage of one type of cheese on the storage device.

In accordance with an additional feature of the invention, the storage device is cooperatively connected to a cheese transfer device for transferring stored cheeses of the one type to the cheese transporter.

In accordance with yet another feature of the invention, the storage device is arranged so as to be longitudinally movable for at least one-half a spaced distance between respective winding stations.

In accordance with a concomitant feature of the invention the invention, the cheeses of different types are cheeses having different yarn lengths.

Other features which are considered as characteristic for the invention are set forth in the appended claims.

Although the invention is illustrated and described herein as embodied in a method and device for combining pairs of cheeses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 and 2 diagrammatically illustrate the principle of cheese pair formation;

FIG. 5 is another fragmentary view of FIG. 3 showing the automatic spooler in an operating phase thereof wherein a cheese of the given type has been released to the storage device and the cheese exchanger is ready to travel on.

Figure 1:
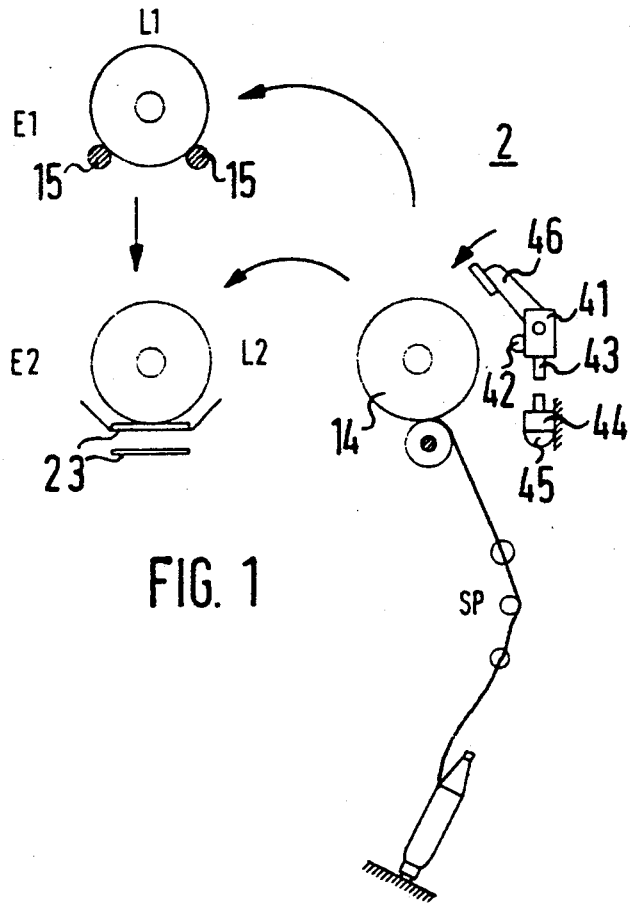

Referring now to the drawing and, first, particularly to FIG. 1 there are shown therein different types of cheeses L1 and L2 produced with the aid of the winding station SP, which are initially deposited in two planes E1 and E2 with the cooperation of a mobile automatic cheese exchanger 2.

Figure 2:
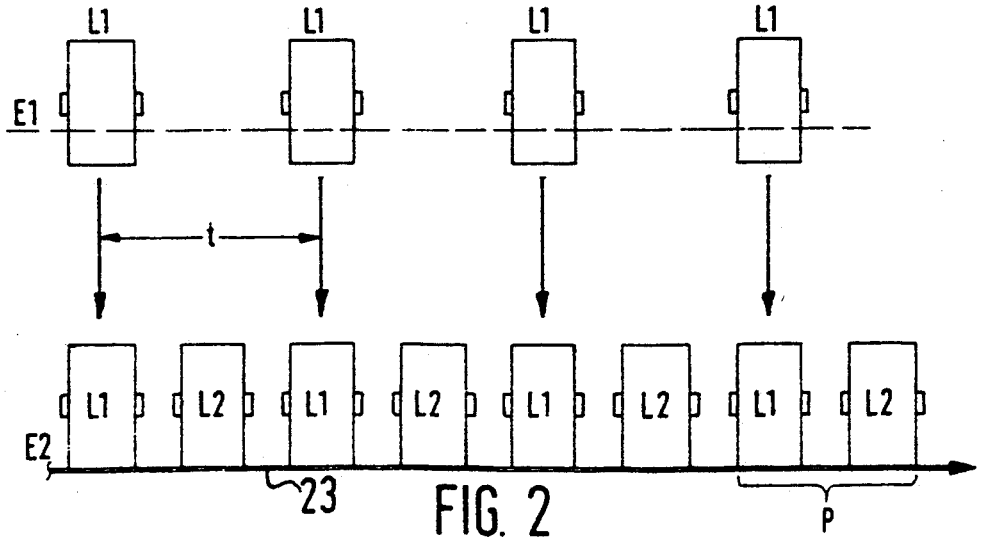

According to FIG. 2 the cheeses L1 finally are disposed next to each other on rods 15 (FIG. 1) of a storage device at a mutual spacing t. The cheeses of the type L2 are deposited directly on a cheese transporter 23 at the same mutual spacing t. The cheese transporter 23, as shown in FIG. 2, is in the form of an upper stringer or run of a conveyor belt. To form cheese pairs P, the cheese transporter 23 is driven according to FIG. 2, in the direction of the horizontal arrow over a distance corresponding to one-half the spacing t, after which the rods 15 with the cheeses of the type L1 are lowered in the direction of the vertical arrows until they rest just above the cheeses of the type L2 located on the conveyor belt 23. Thereafter the rods are slowly pivoted sidewise and the cheeses of the type L1 slowly slide down on to the conveyor belt 23 into the gaps left by the cheeses of the type L2 already located on the conveyor belt.

Thereafter, the rods 15 are raised again and moved towards one another for the purpose of receiving fresh cheeses.

The cheeses now resting on the conveyor belt 23 form cheese or coil pairs P formed of a cheese or coil L1 and a cheese or coil L2 each. The conveyor belt 23 is then driven on in the direction of the arrow towards a discharge station where the coil pairs are removed either manually or automatically or are transported further on. The instant there is room again on the conveyor belt, pair formation begins anew. In the interim, the textile machine producing cheeses, for example an automatic spooler, has had sufficient time to produce fresh cheeses L1 and L2.

An automatic device 41 of the mobile automatic cheese exchanger having a sensor 42 for checking the cheese 14 ready for transfer, is shown in FIG. 1. The sensor 42 determines whether any cheese at all is present and, if present, whether it is the correct size and to what category it belongs. If no cheese of adequate size is present, the device 41 activates a tappet 43 which switches on a microswitch 44 present at the winding station SP. This closes a circuit which causes a trouble indicator light 45 to light up.

If a cheese 14 is present but is not of the predetermined quality, a labeling device 46 is activated. The arm of the labeling device 46 pivots downwardly in the direction of the arrow and applies a label with adhesive to the cheese 14, thus identifying it as a cheese of inferior quality. The corresponding cheese pair which is referred herein as an irregular pair, is later separated out. The winding station is likewise identified by the lighting of the trouble indicator light 45.

If for any reason a cheese is not delivered by the winding station SP, the device 41 transmits a signal to the driving device of the conveyor belt 23 which prevents the clearing of the conveyor belt after it has received cheeses of both types. At the same time, a trouble indicator light similar to that at the winding station SP is activated in order to alert an operator to the fact that a cheese or coil pair is incomplete. The operator either provides the missing coil manually or removes the unpaired or excess coil from the belt and then starts the conveyor 23 for manual clearing.

A defective winding station can then be repaired or exchanged, respectively, without interrupting the rest of the winding operation.

Following this purely diagrammatic embodiment, a further exemplary embodiment operating in accordance with the method of the invention is explained and described with respect to FIGS. 3 to 8.

A textile machine i.e. an automatic spooler, is identified as a whole by reference numeral 300 in FIGS. 3 to 8. It is made up of a plurality of individual winding stations 301 disposed in a row next to one another. Among other things, each winding station 301 has a thread guiding drum 13 which rotates and carries a cheese 14 thereon. The thread guiding drum 13 causes the cheese 14 to be driven by friction and causes a changing placement of the thread in crossed positions. In addition, the winding station 301 has a coil frame 12 which carries the cheese or coil 14 and is rotatable around a pivot point 302. The respective winding stations 301 are connected by brackets 303 to the machine frame 21 of the automatic cheese spooler 300. The machine frame 21 supports a cheese transporter 304. A storage device 305 is disposed parallel to the automatic cheese spooler 300 and parallel to the cheese transporter 304. It is mounted on supports 306

The cheese transporter 304 includes a conveyor belt 23 which rests on conveyor belt supports 24 connected to the machine frame 21.

The storage device 305 has two rods 15 and 15' disposed in a horizontal plane parallel to one another and suspended from cross arms 16 and 16', each of which are connected to a head brace 17 of the support 306. The supports 306, the head braces 17 and the cross arms 16 are located at the front and rear ends as well as opposite non-illustrated intermediate frames of the automatic spooler 300. Such intermediate frames are located, for example, respectively between respective construction groups of ten winding stations 301.

Cross arms 307 connected to the machine frame 21 support a rail 309. Additional cross arms 308 support additional rails 310 and 311. An operating or servicing carriage 2 can travel on the rails along the automatic cheese spooler 300. The operating carriage 2 is an automatically operating cheese exchanger, the function of which is to exchange a fully wound cheese 14 for an empty or unwound coil sleeve or core.

The servicing carriage 2 has drive rollers 312 and 313 with which it rests on the rails 309 and 310. It also has support rollers 314 and 315 with which it abuts against the rails 309 and 311. At least one of the drive rollers is driven by a controlled drive motor in a conventional manner. The servicing carriage 2 can be called automatically, in a conventional manner, to a winding station which is to be serviced and arrested there in order then to exchange a wound cheese for an empty coil core and, at the same time, to perform other tasks, if required, such as cleaning operations, for example.

It is customary to provide one or more sequential control devices for such operating carriages, which control the sequential tasks according to a program. The operating carriage 2 also contains such devices. To the extent that such devices are of importance for explaining the invention they will be discussed hereinbelow.

Figure 3:
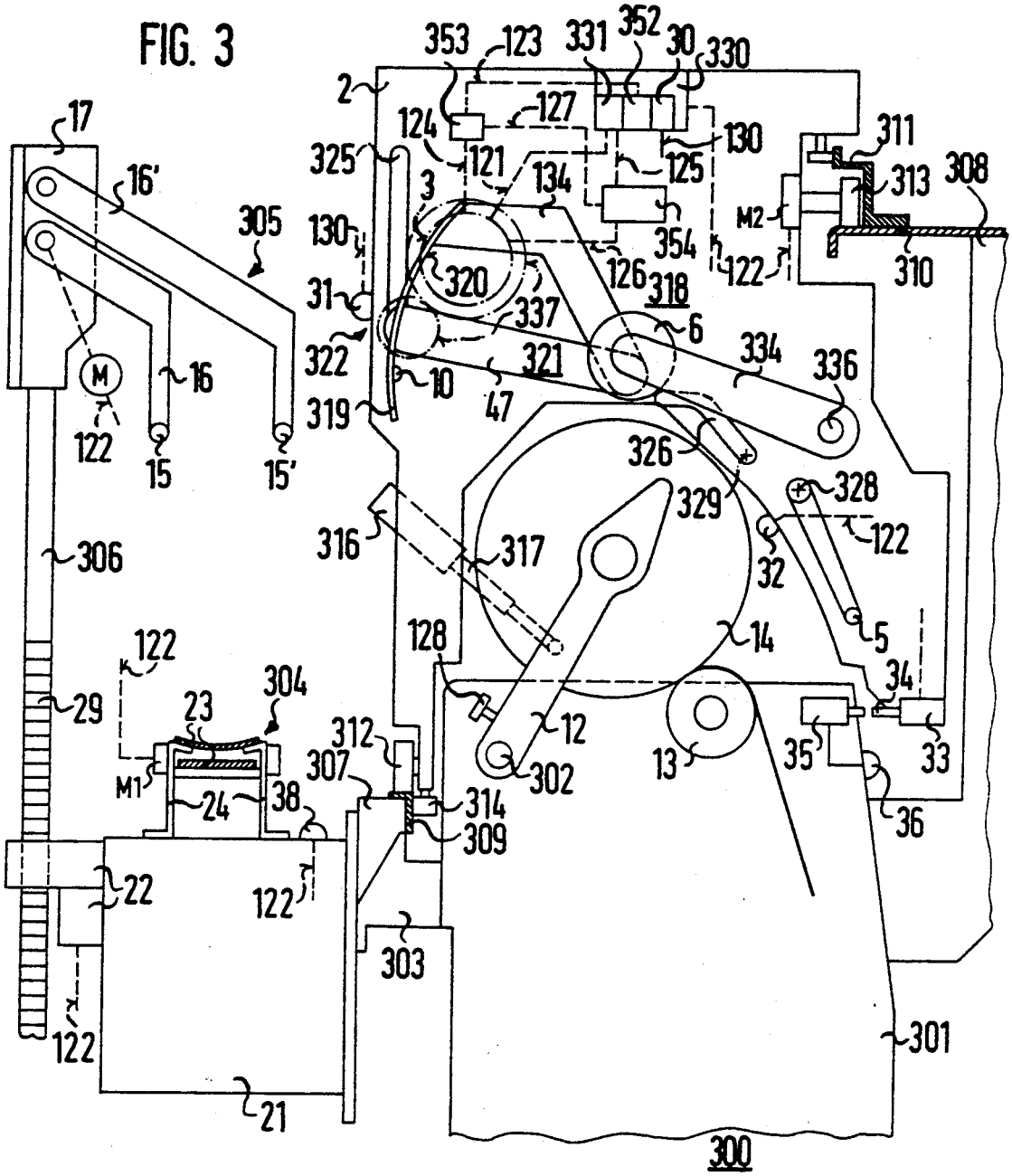
FIG. 3 is a side-elevational view of an automatic spooler with mobile automatic cheese exchanger, cheese transporter and storage device.

The servicing carriage 2 includes, among other things, a pneumatically operating frame opener 316, which is only diagrammatically illustrated in FIG. 3. For opening the coil frame 12, the frame opener 316 extends a telescopic rod 317 which forces the rear support arm of the coil frame 12 sidewise and thus opens the coil frame. In its inactive state, the telescopic arm 317 is retracted into the frame opener 316.

The servicing carriage Z has a cheese transport device, identified as a whole by the reference numeral 318, for removal of cheeses 14 from the coil frame 12 and depositing the cheeses on one of the two cheese receiving devices 304 or 305.

The cheese transport device 318 includes a support element 319 which can be supplied from below to the cheese 14 from a position of rest shown in FIG. 3. According to FIGS. 3 to 5, the support element 319 has a concave coil support surface 320. It is disposed at the end of a support arm 134. Operational connections exist between the support arm 134, a parallel guiding device and a pivot device 322. In addition, the support element 319 has a withdrawing device. This is constructed to free the cheese 14, previously held above the cheese receiving device 304 or 305, by withdrawing the support element 319 along a curved track around the cheese 14 so that the cheese can be lowered to the respective cheese receiving device. The pivot device 322 and the withdrawing device are covered by the housing.

Figure 4:
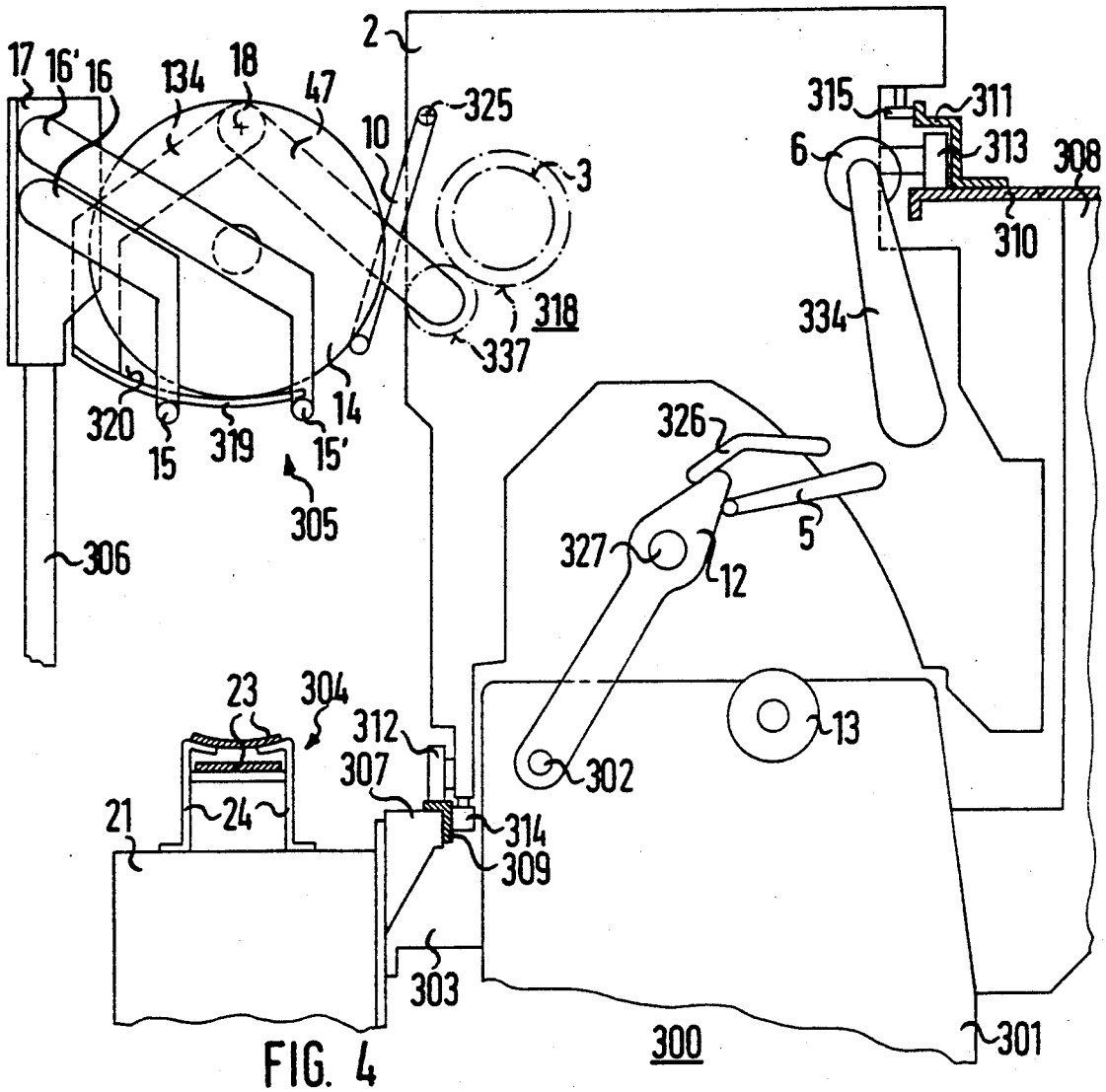
FIG. 4 is a fragmentary view of FIG. 3 showing the automatic spooler in a phase of operation thereof shortly before release of a cheese of a given type to the storage device.
Figure 5:
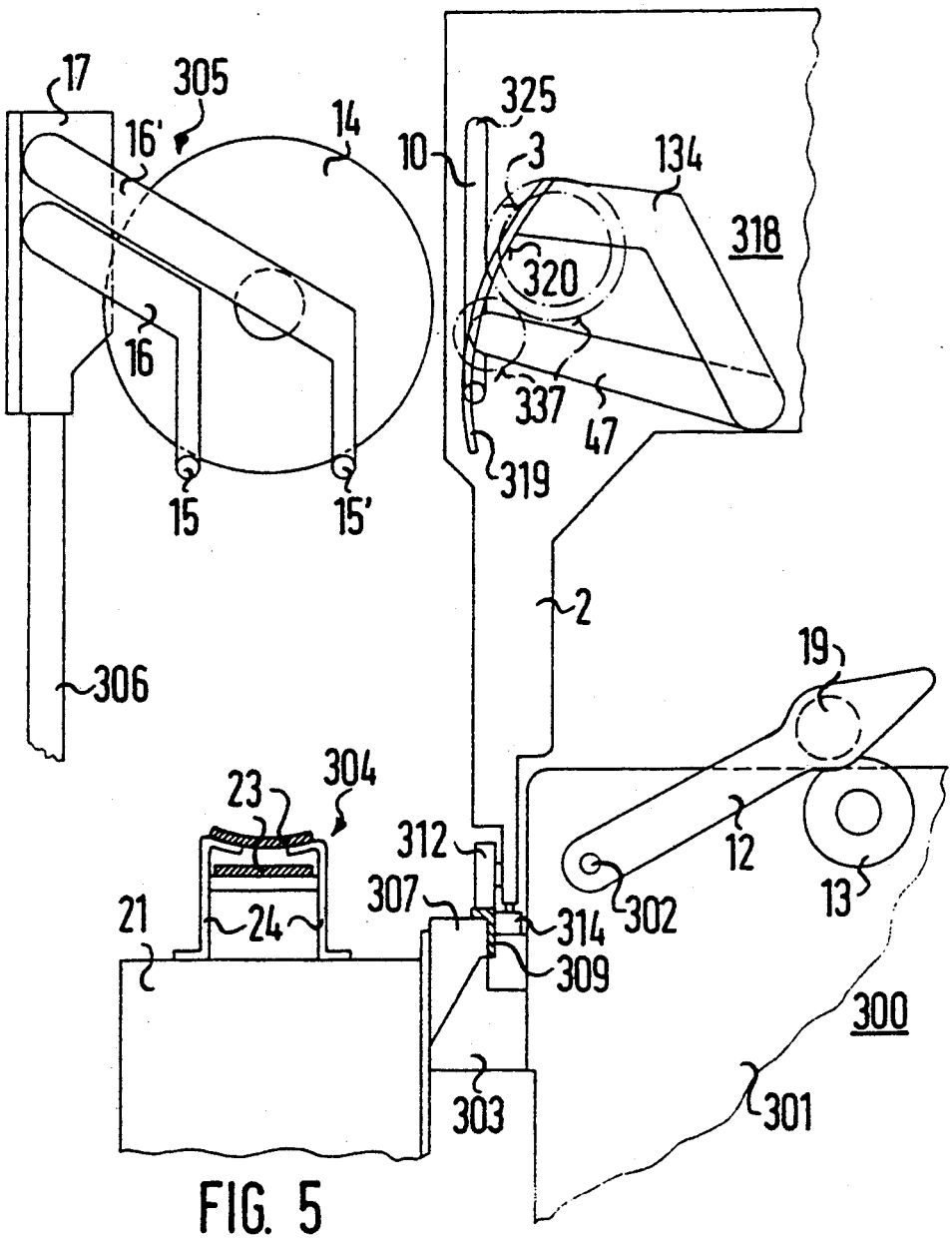
Figure 8:
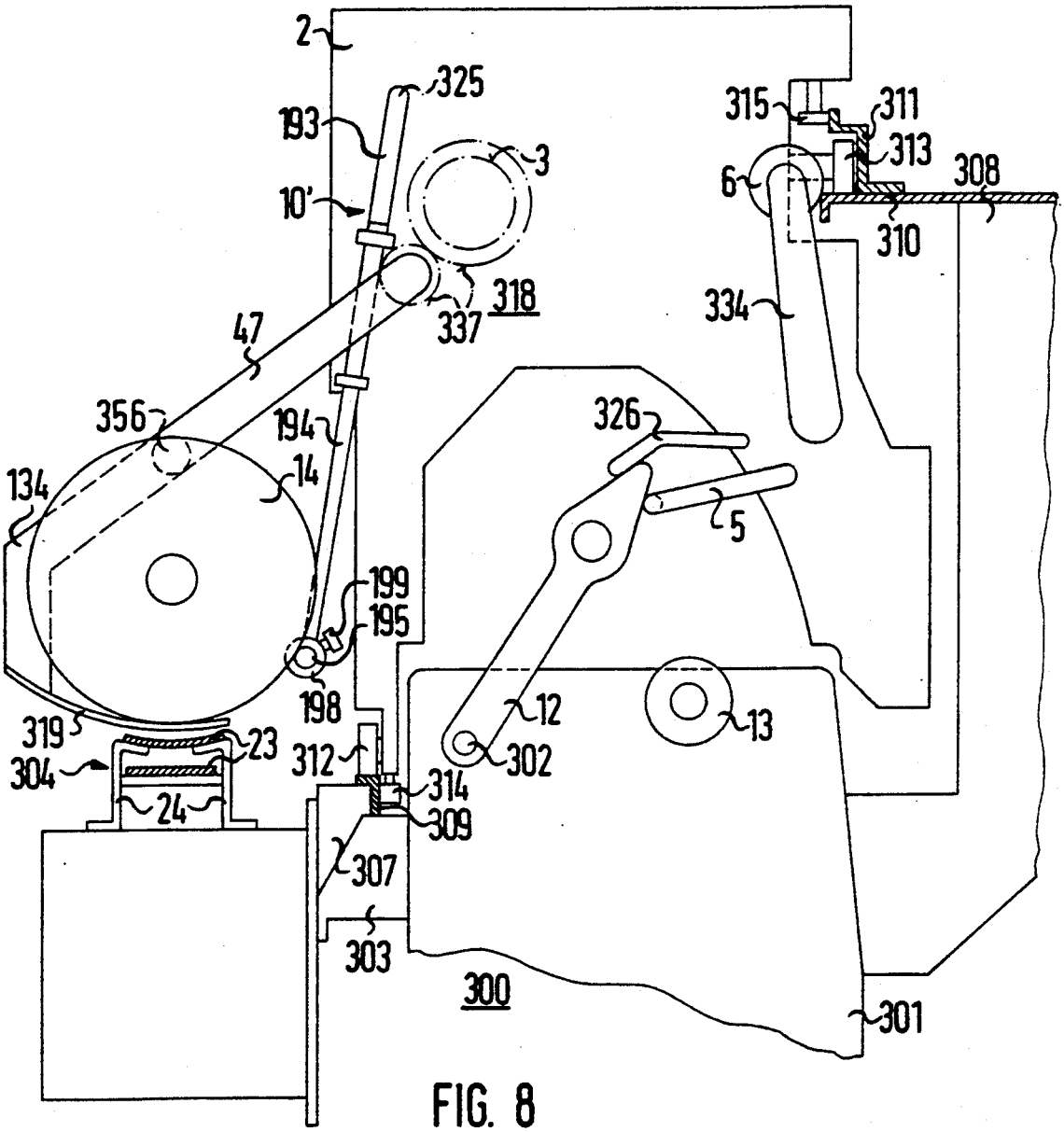
FIG. 8 is an added fragmentary view of FIG. 3 showing the automatic spooler in an operating phase thereof wherein a cheese previously removed from the winding station is located directly above the cheese transporter on which it is to be deposited without detouring by way of the storage device.

Furthermore, the operating carriage 2 has a support element 10 and 10', respectively, which is removable laterally out of its position of rest against the cheese 14, maintained above the cheese receiving device 304 and 305, respectively, and movable back again. FIGS. 3 and 5 show the positions of rest of the support element 10. FIGS. 4 and 5 show operating positions. FIG. 8 shows the support element 10', moved out on a longer lever arm and in its operating position. The support elements 10 and 10', respectively, include a crosspiece fastened to an arm which can be extended to a greater or lesser extent and which is mounted for pivoting on a pivot point 325 on the servicing carriage 2 and can be controlled by the aforementioned sequential control device, such as a cam drive, for example.

Moreover, the servicing carriage 2 has a coil frame lifting device 5 which can act on the rear support arm of the coil frame 12 and which cooperates with a frame tilting device 326 to bring the cheese 14 into a predetermined axial position which is shown, for example, in FIG. 4. In this axial position, each cheese 14, whether it is large or small, is lifted off its thread guiding drum 13 and, furthermore, the cheese axis 327 is always horizontal in this axial position, even if the cheese is a conical coil or bobbin. The frame tilting device 326 cooperates, as shown in FIG. 4, with the front support arm of the coil frame 12. The coil frame lifting device 5 is tiltable upwardly on the servicing carriage 2 about a pivot point 328 from the position of rest, shown in FIG. 3. The frame tilting device 326 is tiltable downwardly from its position of rest shown in FIG. 3 about a pivot point 329. Pivoting is accomplished by the aforementioned control drives, for example, operating with cams.

The pivot arm 334 of a friction roller 6 is mounted on the servicing carriage 2 so as to be pivotable about a pivot point 336.

The friction roller 6 mounted on the pivot arm 334 serves to drive the cheese 14 during defined phases of the coil or bobbin production.

The parallel guidance device mentioned hereinbefore ensures that the support element 319 can neither be canted nor turned nor tilted inadvertently independently of the movement of the support arm 134. The parallel guiding device has a planetary gear 321 with a sun wheel, a planet wheel and a rotational direction-reversing wheel, contained in a bridge 47. By means of a hollow shaft, the bridge 47 of the planetary gear 321 is connected to the driving side of a controlled gear motor 3 which is used as the pivoting element of the support element 319. FIG. 3 shows the geared motor 3 and a gear transmission 337. The bridge 47 is constructed as a protective housing of the planetary gear 321. The gear transmission 337 is shown in phantom.

The sun wheel of the planetary gear 321 is coupled with the support arm 134.

Because the cheese receiving devices are at different heights, the bridge 47 can be brought into any desired angular position, so that the coils or bobbins can be deposited at locations over a relatively large range in height. Depending upon the elevated position of the cheese-receiving device, the arm of the support element 10 and 10', respectively, is extended to different lengths.

In accordance with FIG. 8, the support element 10' is formed of two longitudinal bar sections 193 and 194 and a transverse bar section 195. The longitudinal bar section 194 overlaps the longitudinal bar section 193. At the lower end of the longitudinal bar section 194 is a ball joint 198 into which the transverse bar section 195 has been inserted. Because of the ball joint 198, the transverse bar section 195 can be continuously adjusted over a wide angular range space. After adjustment, the ball joint 198 can be fixed in place by an arresting screw 199.

Instead of the overlapping disposition of the longitudinal bar sections, a telescopic arrangement can be selected which makes possible a pneumatic or hydraulic longitudinal adjustment.

The adjustability of the transverse bar section 195, in particular, facilitates the adaptability of the support element 10' to cheeses of differing conical shape.

When the device according to the invention starts from the position of rest according to FIG. 3, the cam drive of the cheese transPort device 318 mentioned hereinbefore starts up, which effects the pivoting of the support element 319 out of its position of rest into a bobbin or coil- receiving position. The drive motor 3 of the pivoting device 322 is switched on, and the bridge 47 is accordingly pivoted out of its position of rest according to FIG. 3 into a bobbin or coil- receiving position. Concurrently with the start-up of the drive motor 3, a revolution counter 353, connected with the drive motor 3 by a line 124, starts counting the revolutions of the drive motor 3 or of a gear transmission part connected therewith, and transmits the result of the count to a comparator device 352 via a line 123. The result of the count is compared by the comparator device 352 with set values and, once the number of pulses counted by the counter 353 corresponds to the set values, a switching device 331 stops the drive motor 3 via a line 121 by which it is connected thereto. At this point, the support element 319 is located approximately one centimeter below the cheese 14.

Additionally, the switching device 331 is connected by a line 125 to a control device 354. The latter, in turn, is connected via a line 126 to the drive motor 3. The instant the switching device 331 has done its job in each individual case, the control device 354 takes over the further control of the drive motor 3, so that, subsequently, the bridge 47 can be brought into a position suitable for transferring a coil or bobbin to one of the two cheese receiving devices e.g. a position according to FIG. 4 or a position according to FIG. 8. Control of the drive motor 3 by the control device 354 also takes place based on the revolutions counted by the revolution counter 353 and communicated via a line 127 to the control device 354. The number of revolutions of the drive motor 3 is to be calculated empirically.

The control device 354 also controls the return movement of the bridge 47 into the initial position thereof shown in FIG. 3.

Initially, the attainment of the set coil or bobbin size of the cheese 14 is determined at the winding station 301, e.g., by a microswitch 128, which senses the angular position of the coil frame 12 and triggers a signal, for example, for stopping the winding station 301 or, optionally, for stopping the thread guide drum 13, and furthermore causes a demand signal which either immediately calls the servicing carriage 2 or in a conventional manner, causes the servicing carriage 2 to stop as it travels past the winding station 301. To remove the cheese 14, the bobbin or coil frame lifting device 5 and the frame tilting device 326 are actuated in order to bring the bobbin or coil frame 12 with the cheese 14 still clamped in it into a preset axial position 327 (FIG. 4). Then the withdrawal device controls the planetary gear 321, and the control device 330 controls the bridge 47 of the planetary gear 321 in such a way, that the support element 319 comes under the cheese 14 and assumes a spaced distance of approximately 1 cm from the cheese surface. A sun gear 356 (FIG. 8) is coupled to the support arm 134 so that the latter is pivotable about a pivot point 18 (FIG. 4).

If required, operations continue to be performed on the cheese 14 which has already been lifted from the thread guiding drum 13. For example, the thread end is wound on the coil core end or tip as a thread reserve, for which the friction roller 6 drives the cheese 14 for some time after the pivot arm 334 has been lowered. For this purpose, the friction roller 6 has its own non-illustrated drive motor. After the work has been completed, the pivot arm 334 of the friction roller 6 pivots into the alternate position thereof as shown in FIG. 4. Then the frame opener 316, controlled by the sequential control device mentioned hereinbefore, goes into action in order to open the bobbin or coil frame 12, with the result that the cheese 14 is freed from the bobbin or coil frame 12 and reaches the support element 319. The pivot device 322 then turns the bridge 47 in a counterclockwise direction until it, for example, takes up a position in accordance with FIG. 4, and immediately stops due to self-locking caused, for example, by a combination of a worm and worm wheel inside the pivot device 322. During this period, the parallel guidance device 321 i.e. the planetary gear transmission, ensures that the cheese 14 neither tilts nor rolls during transport.

In accordance with FIG. 4, the cheese 14 is already located above the upper storage device 305 i.e the support element 319 is located barely above the rods 15. Controlled by the above mentioned sequential control device, the horizontal part of the support element 10 is then laterally placed against the cylindrical surface of the cheese 14, as shown in FIG. 4. Simultaneously or subsequently, the withdrawal device comes into play. With its aid, the pivot arm 134 supporting the support element 319 is pivoted clockwise so that the support element 319 is withdrawn from the side of the cheese 14 opposite the support element 10, moved under the cheese 14 and around the cheese 14 and in this manner permits the cheese 14 to glide on the storage device 305. The pivot arm 134 pivots about the pivot point 18 indicated in FIG. 4. The support element 319 has been upwardly pivoted along a curved track. The support element 10 laterally abutting the cheese 14 has prevented the cheese 14 from moving to the right or rolling.

After the cheese 14 has been deposited on the rods 15 of the storage device 305, the bridge 47 is returned in a clockwise direction into its initial position according to FIG. 5. The support element 10 is also pivoted back into its initial position.

In the interim, the bobbin or coil frame 12 has automatically received a fresh empty coil core 19 by means of the servicing carriage 2, so that the winding station 301 can again begin the production of a cheese. Unless the servicing carriage 2 has to perform other tasks at the winding station 301, it receives a signal from the winding station to move on to another operational position.

The instant all the winding stations of the automatic cheese spooler 300 have finished winding their cheeses 14 of the first type and have deposited them, the mounted storage device 305 can deposit its content of bobbins or coils.

Figure 6:
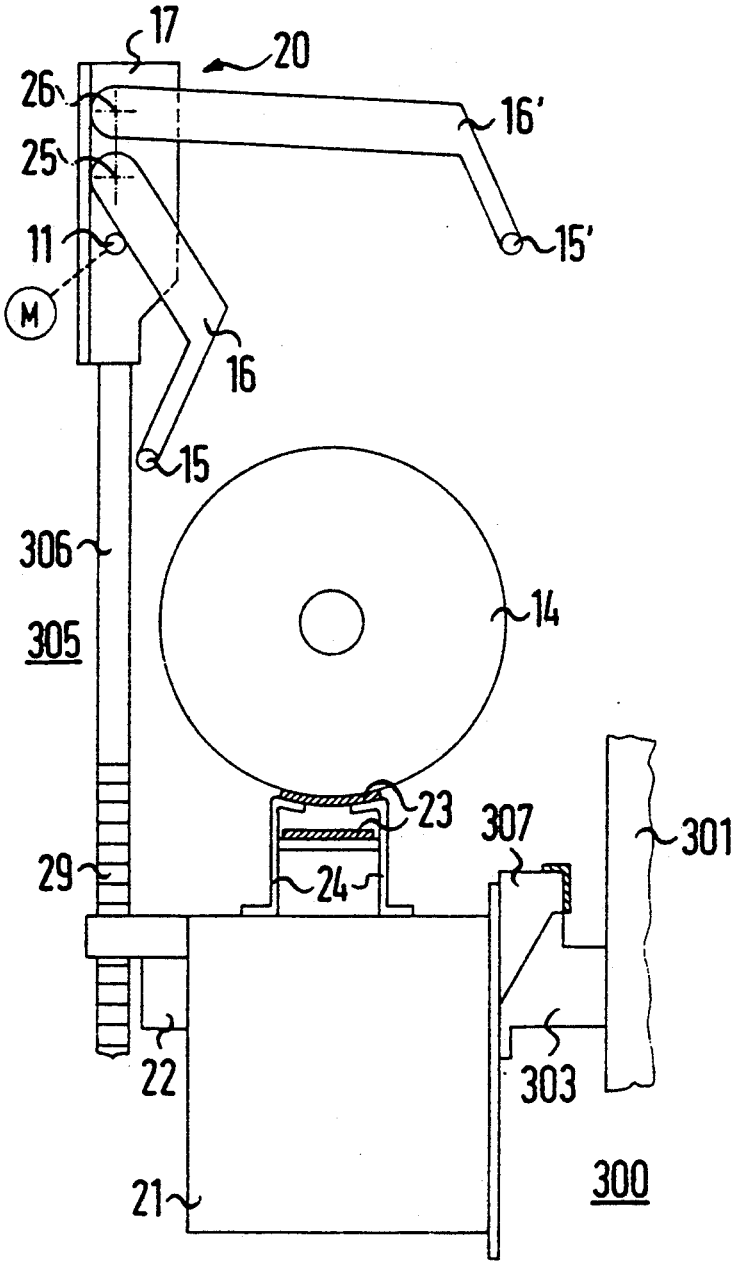
FIG. 6 is a fully fragmentary view of FIG. 3 showing the automatic spooler in an operating phase thereof wherein the storage device has released to the cheese transporter the cheeses of the given type which it had received.
Figure 7:
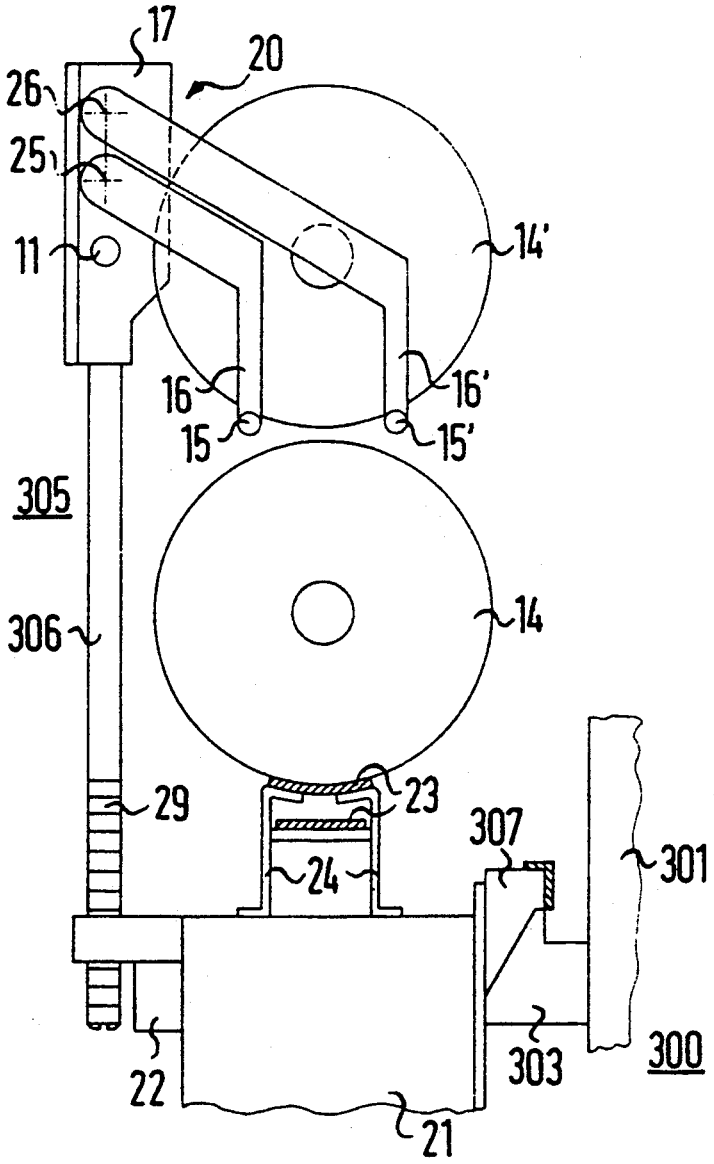
FIG. 7 is an additional fragmentary view of FIG. 3 showing the automatic spooler in an operating phase thereof wherein the storage device has already received cheeses of the second type.

The lifting elements 305 of the pair of longitudinal supports 15 and 15' are disposed in the form of lift columns on one side next to the pair of longitudinal supports. In FIGS. 6 and 7, the respective rear lift column is obscured by the front lift column. The drive heads 17 each hold and control the respective support elements 16 and 16'. Inside each drive head 17 is a gear transmission, identified as a whole reference numeral 20. This gear transmission 20 has three gears which are disposed vertically above one another. The shaft 11 is used for synchronizing the two transmissions 20. It connects the bottom gears of both transmissions 20. The shaft 11 is driven by a motor M which can be alternately switched from a counterclockwise to a clockwise rotary direction and is shown symbolically only in FIGS. 3 and 6. The support element 16 is connected to the center gear and is pivotable about its rotational axis 25. The center gear engages the two outer gears. The support element 16' is connected to the top gear, as viewed in FIGS. 6 and 7, and is pivotable about its rotational axis 26.

The support elements 16 and 16' are inclined obliquely downwardly from the drive heads 17. They are of different length and disposed so that one of the longitudinal supports 15 is, in general, pivotable laterally out of its bobbin or coil- receiving position according to FIG. 5, and the other longitudinal support 15' is pivotable towards the other side and upwardly in a larger arc out of its bobbin or coil-receiving position. The pivoting of the longitudinal supports 15 and 15' and their support elements 16 and 16', respectively, from the bobbin or coil- receiving or take-up position to the bobbin or coil release position takes place outwardly in opposite direction. The return pivoting into the bobbin or coil- receiving or take-up position occurs in the opposite direction. The pivot axis 26 of the longer support element 16' is located above the pivot axis 25 of the shorter support element 16.

FIGS. 6 and 7 show that the lifting columns 306 are disposed at the back of the automated cheese spooler 300 in such a way that their support elements 16 and 16' and the longitudinal pair wise arranged supports 15 and 15' supported by the support elements 16 and 16' are pointing in the direction towards the automated cheese spooler 300. The lifting columns 306 are fastened to the machine frame and foundation 21, respectively, so that they can be moved up and down. The lifting columns 306 can be displaced upwardly or downwardly by a geared motor 22. To this end, the lifting columns 306 are provided, for example, with a toothing 29 which engages a corresponding gear of the geared motor 22.

To transfer the bobbins or coils to the conveyor belt 23, the lifting columns 306 are moved downwardly. Simultaneously, the support elements 16 and 16' are pivoted outwardly by means of the motor M, because of which the cheeses 14 slide onto the conveyor belt 23. Then the lifting columns move up again as shown in FIG. 6.

After the support elements 16 and 16' have again been pivoted towards each other, the longitudinal supports 15 and 15' can receive or take up cheeses of the other type.

FIG. 7 shows that the cheeses 14' of the other type already lie on the longitudinal supports 15 and 15', while the cheeses of the first type lie at a spaced distance behind one another on the bobbin or coil conveyor belt 23.

The control device 330 cooperates with the winding stations 301, the cheese exchanger 2 and the cheese transporter 304. Its control program provides for a control of the cheese exchanger 2 in a way that the cheeses 14 and 14' of both types reach the cheese transporter 304 sequentially and in a respective paired arrangement, that the cheese transporter 304 can only be released for transporting the cheeses 14 and 14' after it contains pairwise arranged cheeses of both types of the preset minimum amount and without any excess individual bobbins or coils and, respectively, when the winding stations 301 have delivered the cheeses 14 and 14' correctly and in a correct number and when the original winding station of irregular cheeses has been identified.

For this purpose the control device 330 has been equipped, among other things, with a counter 30 and furthermore has operational connections with sensors and drive devices. A sensor 31 is connected to the counter 30 by a line 130. The sensor 31 counts the cheeses spaced on the rods 15 and 15' after the cheeses of a certain type have been removed. For this purpose the control device 33 causes the drive motor M2 of the cheese exchanger 2 to make an inspection trip along the automatic cheese spooler 300 for the sole purpose of counting.

For accomplishing this purpose, a common line 122 begins at the control device 330, then branches and is connected to the different sensors and actuating elements which are described in greater detail hereinbelow.

The aforementioned drive motor M2 is, for example, connected to the common line 122.

The common line 122 leads to a further sensor 32 which observes and checks the completed cheese 14. It determines whether the cheese 14 has the correct size and furthermore determines which category of cheeses it belongs to, whether it is a cheese of the first or the second type. The result is reported to the control device 330 and, if it is a cheese of the correct type, this cheese is transferred to the storage device 305 in the manner described hereinabove. If the cheese checked by the sensor 32 should be unsuitable for transfer, the control device 330 causes the activation of a solenoid 33 via the common line 122 which, with its tappet 34, switches on a microswitch 35 at the respective winding station 301 and thus causes a trouble indicator 36 to light up. Additionally, the drive motor M1 of the conveyor 32 belt 23 is released via the common line 122 to move forward only one-half of the spaced distance between the winding stations, but not to transfer received cheeses. During each blockage of the motor M1, an additional trouble indicator 38 is illuminated via the same common line 122. The trouble indicator 38 is located in the vicinity of the belt drive motor M1.

If the sensor 31 has detected a gap in the row of the cheeses located on the rods 15 and 15' in the course of its inspection, the control device 330 also blocks via the common line 122, the two geared motors 22 of the supports 306 and the motor M driving the cross arms 16 and 16'. This blockage can only be removed manually by an operator, who at that time must ensure that no extra bobbins or coils reach the conveyor belt 23 i.e. that irregularities in pair formation are avoided.

The control program of the control device 330 provides that the cheeses of the one type located on the storage device 305 are continuously transferred to the conveyor belt 23 the instant their completeness has been determined by the sensor 31. For this purpose, the geared motors 22 are switched on according to the program to lower the supports 306 and, at the same time the motor M is switched on to spread the rods 15 and 15'. The row of cheeses having the spacing between winding stations 301 glides onto the conveyor belt 23. The control program provides that first the supports 306 are moved up again and then the rods 15 and 15' are again returned to their initial position. During this time, the motor M1 is switched on for a limited time i.e. long enough for the conveyor belt 23 to move forward half the spacing between the winding stations 301.

Transfer of the cheeses of the second type to the storage device 305 and from there to the conveyor belt 23 occurs in the same manner. Because the conveyor belt 23 was previously moved forward by half the spacing between the winding stations 301, the cheeses of the second type now appear exactly between the cheeses of the first type. As soon as this has occurred and the supports 306 have been moved up again, the motor M1 is released for the removal of the cheese pairs then located on the conveyor belt 23.

In the alternate embodiment according to FIG. 8 the cheeses reach the conveyor belt 23 without a detour by way of a storage device. The instant all cheeses of the first type, for example the cheeses 14, lie on the conveyor belt 23, the latter is moved forward half the spacing between the winding stations 301, so that subsequently the cheeses of the second type can be deposited into the gaps or spaces between the cheeses of the first type.

In principle there is also a possibility of programming the cheese exchanger 2 in a way that it deposits cheeses of the first and second type generated in any sequence on predetermined places on the conveyor belt 23. For this purpose, longer or shorter drives from the dispensing winding station to the receiving storage station on the conveyor belt 23 are required, depending upon the particular case.

On a storage device disposed, for example, so that it is longitudinally movable, it is possible, for example, to deposit initially cheeses of the type L1 at spaced intervals t. Then the storage device is displaced one-half the spacing i.e. t/2, and it is possible then to produce cheeses of the type L2 on the same winding stations, for example, and deposit them on the same storage device between the cheeses of the type L1. Then, the cheeses already assembled in pairs will be transferred to the cheese transporter for further transport. A longer spooling machine may have a plurality of such storage devices operating independently of one another so that the spooling machine can be operated with multiple batch coverage. The bobbin or coil transporter itself receives the bobbin or coil pairs of the individual batches sequentially.

The foregoing is a description corresponding in substance to German Application P 37 44041.1, dated Dec. 24, 1988, the International priority of which is being claimed for the instant application, and which is hereby made part of this application.

I claim:

1. A method of combining cheese pairs made up of cheeses of different types in a cheese-producing textile machine having a plurality of adjacent winding stations and a cheese transporter disposed along the machine, the cheese transporter having an end at which the cheeses become disposed for further availability, the cheese transporter including at least one mobile automatic cheese exchanger for removing the cheeses from the winding stations and readying them for further transport, which comprises automatically transferring the cheeses to and depositing them on the cheese transporter pairwise in cooperation with the mobile automatic cheese exchanger while avoiding tipping and rolling of the cheeses; thereafter setting the cheese transporter into motion only when at least one of the following has been determined by automatic devices: that the winding stations have delivered the cheeses in a given manner and in a given amount, that a given amount of cheese pairs is present, that irregular pairs of cheeses and unpaired cheeses are identified as such and that the original winding station of irregular cheeses has been identified.

2. The method according to claim 1, which includes automatically depositing the cheeses of a first type having a given length in a row at spaced distance from one another equal to more than the length of a single one of the cheeses of the first type; and subsequently depositing the cheeses of a second type into the spaces between the cheeses of the first type.

3. The method according to claim 1, which includes initially lining up the cheeses automatically on a storage device disposed along the machine producing the cheeses, and automatically transferring the cheeses together from the storage device to the cheese transporter.

4. The method according to claim 1, which includes initially lining up the cheeses of one type automatically at spaced distances from one another on a storage device and, from there, automatically transferring them all together to the cheese transporter: and then lining up the cheeses of another type automatically at spaced distances from one another on the same storage device, and then automatically transferring them to the cheese transporter. the storage device automatically in the spaces between the cheeses located on the cheese transporter.

5. The method according to claim 4, which includes moving the cheese transporter forward a distance corresponding to one-half the middle spacing of the cheeses of the other type on the cheese transporter.

6. The method of claim 5, which includes depositing the cheeses of the one type on the cheese transporter at a midpoint location between the winding stations, and then moving the cheese transporter forward half of the distance between the midpoint location and the winding stations in order to receive the cheeses of the other type in this position.

7. The method according to claim 1, which comprises always depositing the cheeses of one type automatically at a spaced distance from one another on the storage device only; and always depositing the cheeses of another type automatically at a spaced distance from one another on the cheese transporter only; and, after both the storage device as well as the cheese transporter have had a prescribed amount of cheeses deposited thereon, depositing the cheese located on the storage device automatically in the spaces between the cheeses located on the cheese transporter.

8. The method according to claim 7, which includes moving the cheese transporter forward a distance corresponding to one-half the middle spacing of the cheeses of the one type disposed on the cheese transporter prior to depositing the cheeses of the other type on the cheese transporter.

9. The method of claim 8, which includes depositing the cheeses of the one type on the cheese transporter at a midpoint location between the winding stations, and then moving the cheese transporter forward half of the distance between the midpoint location and the winding stations in order to receive the cheeses of the other type in this position.

10. The method according to claim 1 which includes successively removing with the mobile cheese exchanger cheeses of one type initially, and then cheeses of another type from the winding stations, and depositing the cheeses in a given order.

11. The method according to claim 1, which comprises producing cheeses of one type at given winding stations of the cheese-producing machine, and simultaneously at other winding stations of the machine, producing cheeses of another type and by means of the mobile cheese exchanger, removing the cheeses of both types from the winding stations in any sequence and depositing the cheese in a given order.

12. The method according to claim 1, wherein the cheeses of different types are cheeses having different yarn lengths.

13. Device for combining cheese pairs made up of cheeses of different types in a cheese-producing textile machine having a plurality of adjacent winding stations and a cheese transporter disposed along the machine, the cheese transporter having an end at which the cheeses are disposed for further availability including at least one mobile automatic cheese exchanger for removing the cheese from the winding stations and readying them for further transport, comprising a control device in the cheese-producing machine cooperating with the winding station of the machine, the cheese exchanger, and the cheese transporter, said control device having a control program for controlling the cheese exchanger so that cheeses of two different types reach the cheese transporter in a paired arrangement while avoiding tipping and rolling of the cheeses, and so that the cheese transporter is releasable for transporting the cheeses only if at least one of the following applies: the cheese transporter contains cheese of both types arrange pairwise in a predetermined minimum amount without unpaired single bobbins; the winding stations have delivered the cheeses in a given manner and in a given amount, irregular pair of cheeses or unpaired cheeses have been identified as such, and the original winding station of irregular cheeses has been identified.

14. The device according to claim 13, wherein said control device is cooperatively connected to sensors for performing a monitoring function including at least one of monitoring the winding stations for functioning in a given manner, monitoring the winding station for delivery of the cheeses in a given amount, monitoring the cheese transporter for unpaired single bobbins, and monitoring the cheese transporter for cheese pairs delivered in a given manner and in given amounts.

15. The device according to claim 13 including at least one identification device cooperatively connected with said control device for identifying at least one of the following: unpaired individual bobbins, pair of bobbins not of a given amount, and winding stations not functioning in a given manner.

16. The device according to claim 13, wherein the cheese producing textile machine has a storage device for collecting one type of cheese prior to transferring the cheeses to the cheese transporter, the control device and the mobile automatic cheese exchanger being programmed for interim storage of one type of cheese on the storage device.

17. The device according to claim 16, wherein said storage device is cooperatively connected to a cheese transfer device for transferring stored cheeses of the one type to the cheese transporter.

18. The device according to claim 16, wherein said storage device is arranged so as to be movable for at least one-half a spaced distance between respective winding stations.

19. The device according to claim 16, wherein the cheeses of different types are cheeses having different yarn lengths.

* * * * *